US007983425B2

(12) United States Patent
Luo

(10) Patent No.: US 7,983,425 B2
(45) Date of Patent: Jul. 19, 2011

(54) METHOD AND SYSTEM FOR ACOUSTIC SHOCK DETECTION AND APPLICATION OF SAID METHOD IN HEARING DEVICES

(75) Inventor: Henry Luo, Waterloo (CA)

(73) Assignee: Phonak AG, Staefa (CH)

( * ) Notice: Subject to any disclaimer, the term of this patent is extended or adjusted under 35 U.S.C. 154(b) by 1225 days.

(21) Appl. No.: 11/452,057

(22) Filed: Jun. 13, 2006

(65) Prior Publication Data

US 2007/0286428 A1 Dec. 13, 2007

(51) Int. Cl.
*H04R 29/00* (2006.01)

(52) U.S. Cl. ..... 381/56

(58) Field of Classification Search ..... 381/56–58, 381/102, 104, 106, 107, 98, 94.1–94.4, 94.7, 381/72, 74; 340/384.1–404.3, 540, 545.1–545.9
See application file for complete search history.

(56) References Cited

U.S. PATENT DOCUMENTS

| | | | | |
|---|---|---|---|---|
| 5,579,404 | A | 11/1996 | Fielder et al. | |
| 7,567,845 | B1 * | 7/2009 | Avendano et al. | 700/94 |
| 2005/0018862 | A1 * | 1/2005 | Fisher | 381/98 |
| 2006/0147049 | A1 * | 7/2006 | Bayley et al. | 381/56 |

FOREIGN PATENT DOCUMENTS

| | | | |
|---|---|---|---|
| DE | 10 2004 041199 | A1 | 3/2006 |
| EP | 1 471 767 | A | 10/2004 |
| WO | 03 003790 | A | 1/2003 |

OTHER PUBLICATIONS

International Search Report dated Jan. 31, 2007 for corresponding application PCT/EP2006/063136.

* cited by examiner

*Primary Examiner* — Xu Mei
*Assistant Examiner* — Lun-See Lao
(74) *Attorney, Agent, or Firm* — Pearne & Gordon LLP

(57) ABSTRACT

The present invention provides a method for detecting acoustic shock in an audio input signal (s(t)), comprising the steps of monitoring the input signal (s(t)) in the time-domain. Thereby detecting the signal floor (Sn), detecting the peak level of the input signal (L), detecting the attack time of the input signal (t1-t0), detecting the duration of the input signal (T). Based on those detections, determining a shock contrast level (SCL) as difference between the peak level (L) and the signal floor (Sn), determining a shock index (SI) by use of a shock index normalization constant (σ) and comparing the shock contrast level (SCL) and the shock index (SI) with respective thresholds and indicating an acoustic shock if one or both thresholds are exceeded. Thus, the present method provides a quick and reliable shock detector that operates in the time-domain. The shock detection takes place with zero time delay, or even predicts the shock before it fully goes through the signal processing.

21 Claims, 8 Drawing Sheets

METHOD AND SYSTEM FOR ACOUSTIC SHOCK DETECTION AND APPLICATION OF SAID METHOD IN HEARING DEVICES

TECHNICAL FIELD

The invention relates generally to a method and system for detecting acoustic shock signals in audio signals and to applications of that method in hearing devices.

Furthermore, the invention relates to further reduce or minimize detected shock effects in audio signals.

BACKGROUND OF THE INVENTION

Detection of acoustic shock is a well-known problem in signal processing. Acoustic shock signals are referred to as impulse signals or transient signals. The nature of an impulse signal is such that its amplitude suddenly changes within a very short duration. There are two typical types of transient signals: aperiodic and periodic signals. An aperiodic impulse is for example generated by an explosion, gunfire or a firecracker. Aperiodic shocks last for very short timeframes such as 250 μs or less. On the other hand, a periodic impulse is usually generated from an impact between two mechanically and acoustically un-dampened objects such as two glass bottles hitting each other. Periodic shocks usually have much longer durations in the order of 5 to 200 ms, and also usually have a lower peak level. Periodic shocks consist of multiple peaks, which come closely one after the other and have attenuated peak levels during their duration.

Many different approaches have been developed to address the detrimental effects of such acoustic shocks. General input-output compression strategies such as WDRC (Wide Dynamic Range Compression) reacts too slowly versus the very fast acoustic shock impulses. MPO (Maximum Power Output) in the frequency domain can be applied to prevent overshooting, but it is also too slow to be effective. Peak-clipping in the time-domain such as time-domain MPO is effective and fast, but it usually causes serious distortion of sound quality. For shock detection, high pass filters are often used; since the transient noise has most of the energy at high frequencies (sudden signal changes mean rich high frequency components). Low-pass filters are also often used to attenuate the transient noise without affecting simultaneously speech content of the signal.

A sub-band-based acoustic shock algorithm has been presented by Todd Schneider et al. in EP 1,471,767. A pattern analysis-based approach is taken to an input signal to perform feature extraction. A parameter space is identified, which is corresponding to the signal space of the input signal. A rule-based decision approach is taken to the parameter space to detect an acoustic shock event and, then, the shock is removed from the input signal to generate a processed output signal. The sudden sound increase is detected with a block frame of a number of samples in time-domain and similar detection also happens within each sub-band. An additional sample delay of a further number of samples is used to allow the time-domain measurement enough time to notify the shock detection module in the frequency domain about the presence of a high level input before the shock reaches the filter bank, thus providing extra time for the shock-detection module to react. The shock detection module in the frequency domain detects if a shock has occurred in a particular sub-band, and determines the sub-band energy measurement to be used for the gain calculation. A state machine is used for sub-band shock determination by examining the sub-band energy with the shock flag. The acoustic shock phenomenon is eliminated by applying the appropriate gain reduction to the signal in each sub-band. The described technology in said document works well for some kinds of slow shocks since it samples input signal energy with a block of a number of samples of about 0.5 ms. However, many fast shocks can be much shorter than 0.5 ms and they may not be detected with this block level. The additional time-delay is required for the system, but can cause new problems for hearing aid devices since the overall signal delay over 10 ms can be perceived as noticeable acoustic latency, which is not desired.

The shock detection in the sub-band is very expensive cycle budget-wise and also difficult to synchronize with the time-domain parameter extraction. The sub-band strategy will not be able to detect very fast shocks reliably and accurately since the filter bank can smear the actual sound level change. It is also not desired to eliminate the shock in individual sub-bands, because this may cause the user to lose environmental awareness and, hence, not perceive correctly the nature of the shock, which might be very important information for the user. It is also expensive to implement this approach and to optimize this algorithm with existing hearing device technology. More complex hearing device systems may also suffer from excessive input-output latency or require very expensive computing power to process this strategy.

U.S. Pat. No. 5,579,404 describes a digital audio limiter. This signal processing system comprising components such as split-band perceptual coders that receive a peak amplitude limited input audio signal and can process the signal in such a manner that the processed signal preserves the apparent loudness of the input signal but is no longer peak-amplitude limited. In one embodiment, up-sampling is used in estimating the resultant peak amplitude and gain factors established in response to the estimated peak amplitude are applied to one or more frequency sub-bands of the processed signal.

Long signal-delay may thus be required and the duration of the delay is usually set substantially equal to the length of time required for control system to respond to PLI (Peak level increase) requiring correction. Furthermore, this technology is more focused on broadcasting or audio recording and therefore no acoustic environment factors are considered. The signal processing required for the system, particularly peak estimator (prefer to up-sample the input signal), is higher than it is available in low-power digital systems such as digital hearing devices, thus this system is not suitable for miniaturized, low-power digital devices.

A method for processing an input signal to generate an output signal, and application of said method in hearing aids and listening devices is described in US 20030031335 A1.

This method and system for defining a threshold value are described to limit the output signal of a processing unit which is fed with an input signal. According to the invention, an input-signal level is determined and the threshold value is set as a function of that input-signal level to prevent the maximum output level in the device from exceeding a predefined threshold value, which protects the user of the device from excessive noise exposure. By virtue of the fact that the threshold value is set as a function of the input-signal level, i.e. in adaptive fashion, it is also possible to limit transient noise whose level is well below the maximum value of the threshold value. As a result, when this method or system is applied in a hearing device, the hearing comfort of the wearer of the hearing device can be significantly enhanced.

Detecting acoustic transient signal well for average level or higher level acoustic environments since the threshold value can be set by defining a momentary mean level of the input signal. A time-based mean value across the magnitude of the input signal is calculated with the averaging performed over a relative long time interval which may be a time span of for instance 5 seconds.

This method uses a known fact that human speech occupies a dynamic range of about −15 to +18 dB (decibels) around the respective mean level; in quiet surroundings with little ambient noise, this mean level is about 60 to 65 dB. A minimum threshold level such as 80 dB is required in order to not affect any first spoken syllable before the mean level has returned to 60 dB.

This method can effectively detect stronger transient signal over average acoustic environment such as 60 dB. If the minimum threshold level is dropped below 80 dB, it can affect speech signal. On the other hand, the transient signal below 80 dB in the quiet acoustic environment, such as 40 dB, can result in big perceived shock since the gain at this soft input level is usually very high.

In known digital systems and devices, the above described known solutions are implemented in the form of shock reduction algorithms. Many of these are based on peak-clipping in order to minimize delay, but, which, as previously stated, usually introduce artifacts or distortion into the signal. Some more advanced peak-clipping technologies use an adaptive clipping threshold to handle different levels of shock. However, the problems of distortion or uncomfortable artificial effects still cannot be avoided with adaptive peak clipping. Some other more sophisticated shock reduction algorithms detect transient noises in both the time-domain and individual frequency bands, then apply shock reduction in specific frequency bands while keeping the normal signal in other frequency bands untouched, as presented in the above mentioned EP 1,471,767. Although many of these algorithms are quite successful for telecommunication applications, typically experienced by a user through headphones or a headset, they usually need to add more delay and require intensive computational power. Since hearing devices possess limited computational power, this restricts the application of such techniques.

Furthermore, the requirement in this regard is different in hearing devices compared to other audio devices, in that acoustic shock should never be cancelled out completely in hearing devices, even if technically possible to do so. Acoustic shock is a type of acoustic event, which belongs to the acoustic environment. It is important that any acoustic event is not taken away from the user for his safety. In extreme examples such as a gun shot or car crash, common sense dictates that the user should be able to sense such an event so that he or she can react accordingly, but this is also true in more moderate cases of acoustic shock such as dishes breaking or a door slam.

SUMMARY OF THE INVENTION

It is an object of the present invention to provide a method of reliably and fast detecting acoustic shock events in audio signals.

It is a further object of the present invention to provide an additional method of managing acoustic shock events after its detection in order to input such events to the user in a reasonable range without causing hearing damage or discomfort.

It is a further object of the present invention to provide a method of detecting reliably and rapidly acoustic shock within an acoustic input signal with a minimum of computational effort and to consequently attenuate or cancel the shock while maintaining the input signal unaffected.

These objects are achieved by the invention as claimed.

The present invention provides a method for detecting acoustic shock in a audio input signal (s(t)), comprising the steps of

- monitoring the input signal (s(t)) in the time-domain, thereby
- detecting the signal floor (Sn),
- detecting the peak level of the input signal (L),
- detecting the attack time of the input signal (t1-t0),
- detecting the duration of the input signal (T),
- determining a shock contrast level (SCL) as difference between the peak level (L) and the signal floor (Sn),
- determining a shock index (SI) by use of a shock index normalization constant (σ)
- comparing the shock contrast level (SCL) and the shock index (SI) with respective thresholds and
- indicating an acoustic shock if one or both thresholds are exceeded.

Thus, the present method provides a quick and reliable shock detector that operates in the time-domain. The shock detection takes place with zero time delay, or even predicts the shock before it fully goes through the signal processing.

In one embodiment, the signal floor (Sn) is obtained through a signal processing method catching up the non-transient signal change over time. For example, the signal processing method is provided by a lowpass filter or a fast smooth signal processing. Thus, the signal processing method is catching up the non-transient signal change over time.

In one embodiment, the method further comprises the step of applying anti-shock gain reduction (g(t)) when a shock event has been indicated. Thus, the acoustic shock is not only detected but as well adaptively reduced, thereby keeping the natural sound quality of the shock events for environmental awareness.

Based on this method, it is not only possible to detect and treat a single shock event, but also multiple shock events, even with different strength of the individual shocks.

The present invention further provides a system for performing the claimed method. This system is adapted to be used in small devices with only limited electrical power, such as in hearing devices.

Thus, there is provided a hearing device with adaptive shock management qualities to achieve a natural anti-shock treatment without impacting audio signals such as speech or music, thus keeping the acoustic shock event natural and comfortable for the user of the hearing device.

DESCRIPTION OF THE DRAWINGS

For purpose of facilitating and understanding of the invention, a preferred embodiment thereof is illustrated in the accompanying drawings to be considered in connection with the following description. Thus the invention may be readily understood and appreciated.

DESCRIPTION OF PREFERRED EMBODIMENTS

Figure 1:
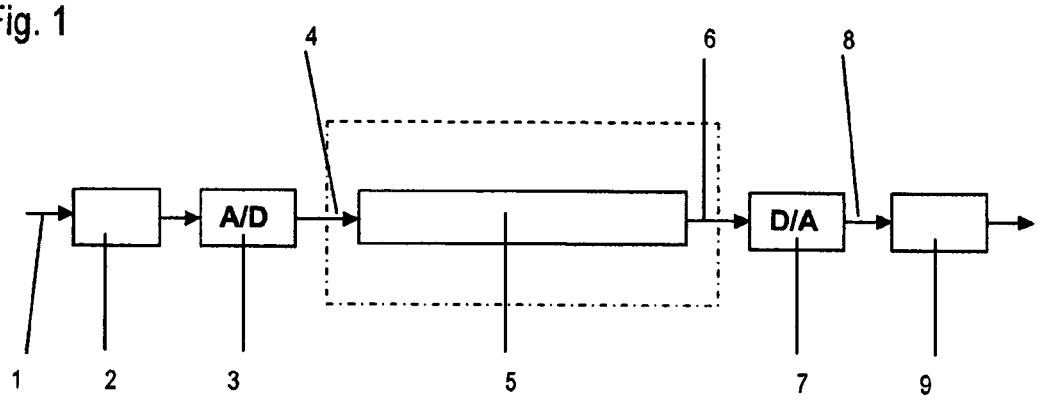
FIG. 1 schematically, a block diagram of an anti-shock system according to the present invention.

Referring to FIG. 1, a purely schematic overview of the present anti-shock method and system is shown. The sound input 1, a mixture of signal and noise, is first acquired by a transducer 2, i.e. a microphone, and then converted to a digital input signal 4 by an A/D converter 3. This digital input signal 4 is then fed to a digital subsystem 5 comprising the below described anti-shock system. A digital output signal 6, which has been treated by the anti-shock system by applying the present anti-shock method as well as by other digital components such as filters and amplifiers within the digital subsystem 5, will then be converted by a D/A converter 7 into an analog output signal 8 that will be applied to a receiver for outputting a corresponding sound 9.

Figure 2:
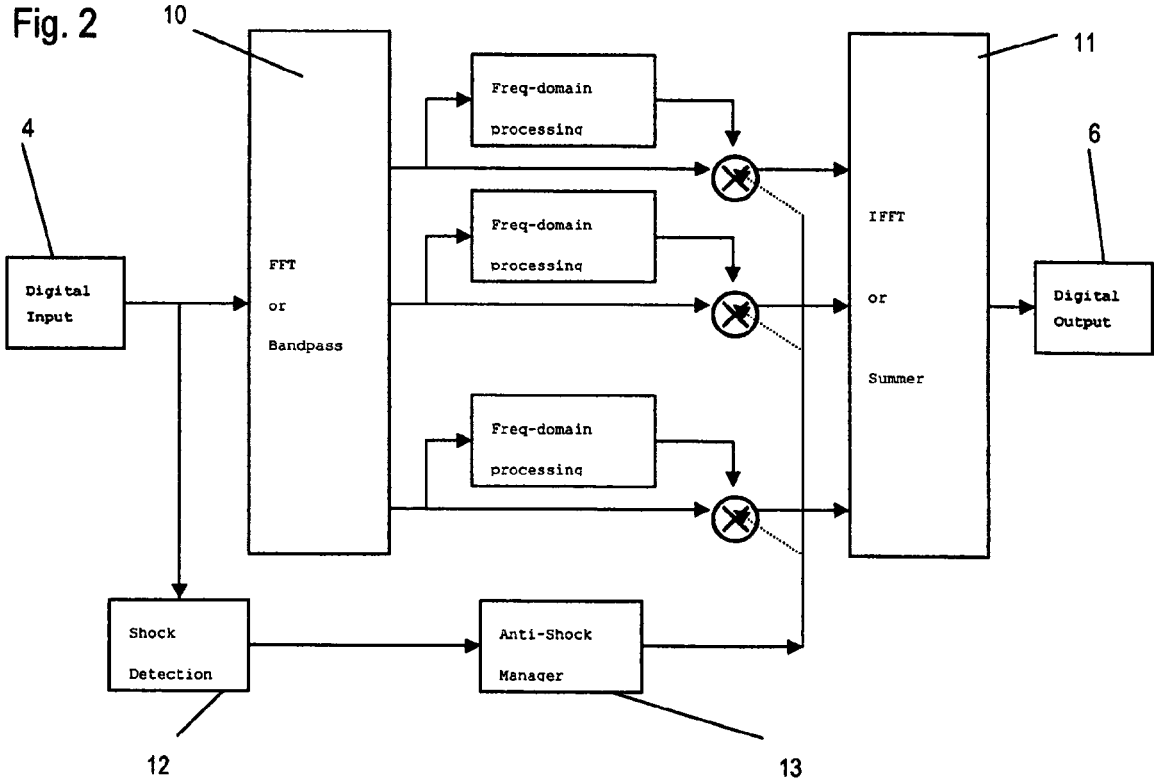
FIG. 2 again schematically, a more detailed block diagram of an embodiment of the digital subsystem of FIG. 1 according to the present invention.

Referring now to FIG. 2, an example of a digital subsystem according to FIG. 1 is described in more details. The digital input signal 4 is on one path framed and windowed with a low-pass filter 10. The windowed data is then converted from the time domain to the frequency domain via a time-to-frequency transformation such as 2N-point FFT. The coefficients of the 2N-point FFT represent N frequency bands of a band-pass filter-bank. The signal strength of a band is calculated from its FFT coefficients. The signal strength of the band in the frequency-domain varies with time. In addition, the input signal changes its frequency components over time. The signal at each frequency band is processed accordingly.

A frequency-to-time transformation such as reverse FFT 11 is then applied to convert the coefficients from the frequency-domain to the time-domain, providing a digital output signal 6 that may be converted to an analog output signal with a D/A converter 7, as shown in FIG. 1.

It is to be noted that the transformation of the digital signal between the time-domain and frequency-domain also can be performed with other methods such as band-pass filters or wavelet transforms.

On a second path, the digital input signal will be introduced into a shock detection module 12 for an immediate detection of a shock. This shock detection module 12 thus continuously monitors and detects the digital input signal 4 in real time in the time-domain.

Figure 3:
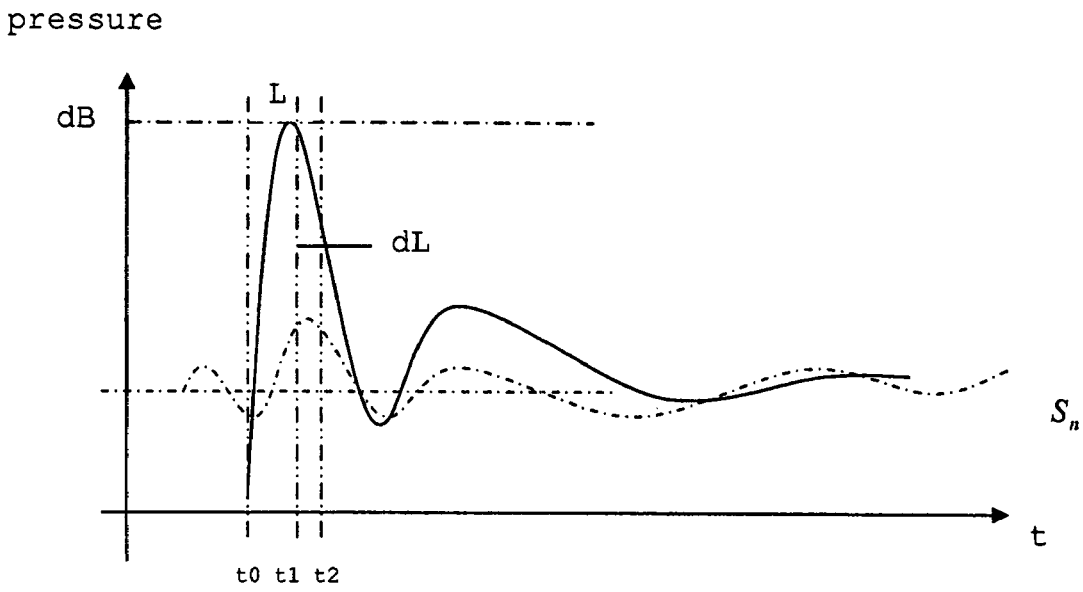
FIG. 3 a plot of a curve showing the signal of a typical aperiodic shock signal as a function of time.

FIG. 3 depicts the plot of the curve of the Signal s(t) of a typical aperiodic shock event as a function of the time t. A periodic shock can be viewed as if it consists of a train of attenuating aperiodic shocks. Therefore, the detection of a periodic shock can be treated as a set of individual detections of aperiodic shocks, which follow one after the other.

In a real world environment, the shock event could start off with soft shocks and then be followed by stronger shocks. Therefore, the detection of shock needs to be designed to handle each individual shock independently. Then, an adaptive shock reduction can be applied accordingly to handle different kinds of shock within a set of successive shocks. With this approach, shock detection is simplified and different shock reduction strategies can be applied to different kinds of individual shocks.

The shock shown in FIG. 3 has a peak level L (in decibel) at time t1 and a duration T=t2-t0. Time t0 is defined as the starting point of the shock and time t2 is defined as the half-way point between peak level L and the signal floor Sn. The shock contrast level dL (in decibel) is:

$$dL=L-Sn$$

Where the signal Floor Sn can be obtained through a fast smooth processing that can catch up the non-transient signal change over time. As an example, Signal Floor Sn here is using the fast average $$Sn = 10\log\left[\frac{1}{T_0}\int_{t-T_0}^{t}|s(t)|dt\right]$$

where $T_0$ is the duration of the fast average.

In such a Signal Floor Sn, the fast averaging of input signal s(t) is processed over a short duration such as 1 ms so that it can reflect the normal speech signal or the music signal change over time. Other smoothing functions of s(t) can be applied to derive Signal Floor Sn to achieve the same characteristic as the above fast averaging example. The higher the shock peak level L, the stronger the shock will be perceived. For the same source of shock, the perceived shock strength depends on the actual shock contrast level dL and the duration T. With the same shock peak level L, the lower the signal floor Sn, the higher the shock contrast, which will result in a stronger shock impact perception. Also, the longer the duration T of the shock, the stronger the shock will be perceived. Therefore, it is critical to detect the shock duration T and shock contrast level dL in order to determine the shock impact and the necessary solution in managing the shock with an appropriate anti-shock strategy.

The absolute shock impact level (SIL) is:

$$SIL = \frac{L}{t_1 - t_0}$$

and the shock energy strength (SES) is:

$$SES = \frac{L}{t_1 - t_0} * (t_2 - t_0)$$

That means: the higher the shock peak level L is, the shorter the attack time (t1-t0) and the longer duration T are, the stronger the shock is perceived.

Therefore, the relative shock impact level can be expressed as the Shock Index:

$$SI = \sigma\frac{L - Sn}{t_1 - t_0}$$

where σ is the coefficient for Shock Index normalization. The shock index normalization constant σ can be defined according to the individual's preference.

In an exemplary system, σ may be defined by referring to a typical dish transient noise with a shock level L=70 dB in quiet (Sn=40 dB) with 0.2 ms attack time (t1-t0) and 10 ms duration T.

By applying the formula for the Shock Index SI, σ will be 0.0067 (ms/dB) with SI=1 as normalized shock index.

If the environment noise level increases for the same dish noise, the shock index SI will drop. The constant may be defined by using other typical shock events or shock sounds respectively as a reference for the normalization. The relative shock energy E may be measured as follows:

$$E = \frac{L - Sn}{t_1 - t_0} * (t_2 - t_0)$$

Therefore, two thresholds, the minimum shock contrast level (MCL) and the minimum shock Index (MSI), are used for shock detection. These two thresholds (MCL; MSI) can be determined through a self-learning process or pre-determined measurement so that daily life non-transient signals such as speech, music, normal acoustic sound are not detected as shock, and that a transient sound such as a gun shot or a door slam will be detected as shock. A stronger and sharper shock will generate a stronger shock Index SI. The duration of shock T will be used together with shock index SI as the measurement of shock strength, which is used for anti-shock reduction control.

The shock detection runs in real-time with the use of the thresholds of minimum shock contrast level (MCL) and minimum Shock Index (MSI). The present shock detection includes the shock detection as such and the shock strength detection. According to the shock contrast level dL and Shock Index SI, it can determine whether a shock happens and how strong the shock is. Since the shock detection runs continuously, the shock can be detected anytime as long as it meets with the shock detection criteria; it is not necessary that shock detection happens solely at the shock peak time. This implies that a shock can be detected during its build-up process before it reaches its peak level. The continuous growth of the shock will result in up-dated shock detection with stronger shock contrast and stronger shock index SI, which will overtake the previous shock detection.

After detection of a shock, an anti-shock management module has to react for reducing or minimizing the shock effect, by keeping the shock sound as natural as possible to allow awareness by the user of the shock event. Furthermore it should keep the relative loudness of shock so that the user can perceive the shock level and keep the shock within a comfort range of the user.

Figure 4:
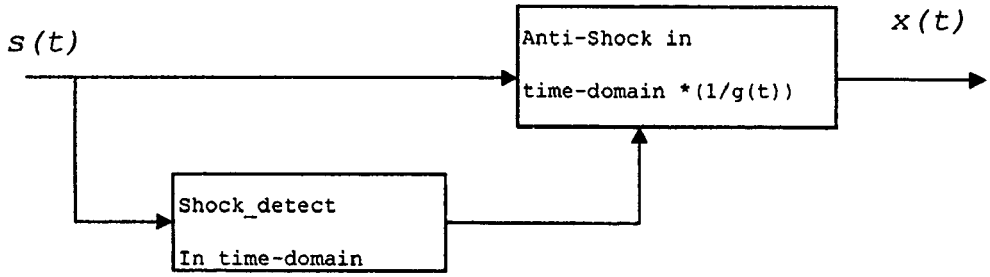
FIG. 4 schematically, a block diagram of the detection and treatment of a signal both in the time-domain according to the present invention.

In a first embodiment, the shock detection and the anti-shock management will be both performed in the time-domain, as depicted schematically in the block diagram of FIG. 4.

Figure 5:
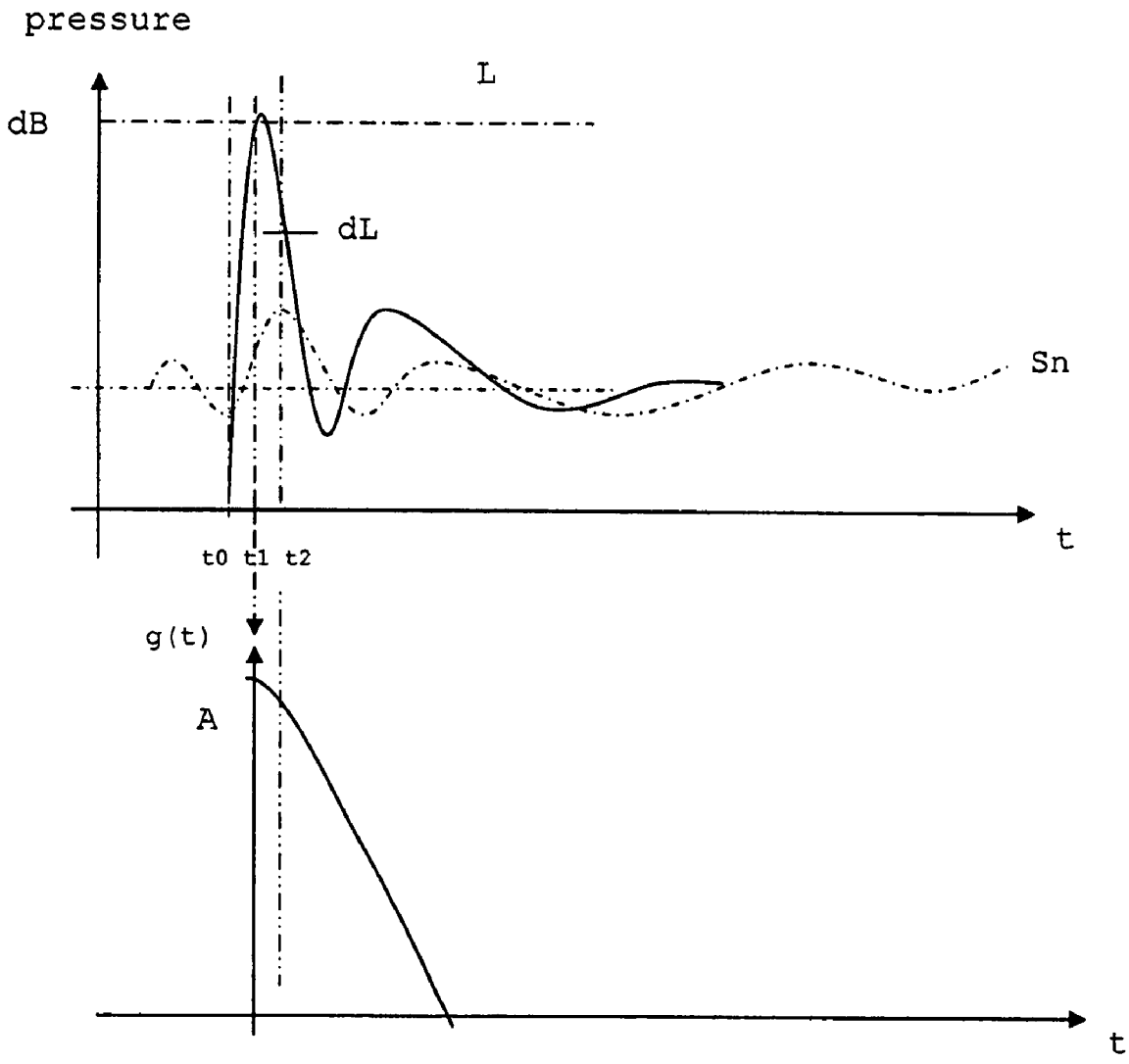
FIG. 5 a double plot of curves showing above the signal of a typical aperiodic shock signal as a function of time and below the implemented gain reduction as a function of time.

The shock peak thus can be detected without delay but the anti-shock process could be delayed until a shock is detected. Therefore, a few samples of signal delay such as 250 μs (i.e. n=4 for sampling rate 16 kHz) for anti-shock management is required. As can be see from the lower curve of FIG. 5, the whole shock part cannot be handled with the anti-shock process in the time-domain without adding additional delay, which will cause distortion of shock event.

Hence, additional time delay is required to be added by these few samples in addition to the existing system time delay. Adding additional time delay at this juncture could cause artificial effects on the input signals. The threshold delay beyond which this negative impact would happen is determined by the overall system delay, the type of shock and the actual shock detection. If the shock detection takes longer time, more samples, and thus more delay, is needed to reduce the artifacts. On the other hand the more delay is implemented due to this fact, the overall system delay could become longer than desired. Therefore, these two mechanisms are balanced to reduce artifacts and keep the overall system delay below the desired threshold.

The anti-shock manager will apply anti-shock gain reduction g(t) to the input signal s(t) to get a new signal x(t) with anti-shock processing already completed after a shock is detected. As one typical implementation of the embodiment, anti-shock gain reduction g(t) is defined as:

$$g(t)=A\exp^{-\beta(t-t1)} \text{ with } t\epsilon(t1,t2)$$

where

A is the anti-shock strength, and

β is a time constant for anti-shock control.

After t>t2, $$g(t)=(A\exp^{-\beta(t2-t1)})\cdot\exp^{-\lambda(t-t2)}$$

where

λ is a time constant for anti-shock release.

As can be seen, time constants β and λ can be different to achieve different release speeds at different durations for different purposes; or be the same to simplify the anti-shock release process.

As one typical implementation, it may be desired to have slow anti-shock release for the peak shock duration (tϵ(t1,t2)) so that the shock can be efficiently controlled. In another typical implementation, it may be desired to have fast anti-shock release for the peak shock duration (tϵ(t1,t2)), so that the useful signal following the shock is less affected. In a further typical implementation, it may be desired to use the same anti-shock release speed in order to simplify the design.

In addition to using the above gain reduction function g(t), different activation functions can be selected according to the shock type and the user preference. A very simple one is linear reaction to shock.

Figure 6:
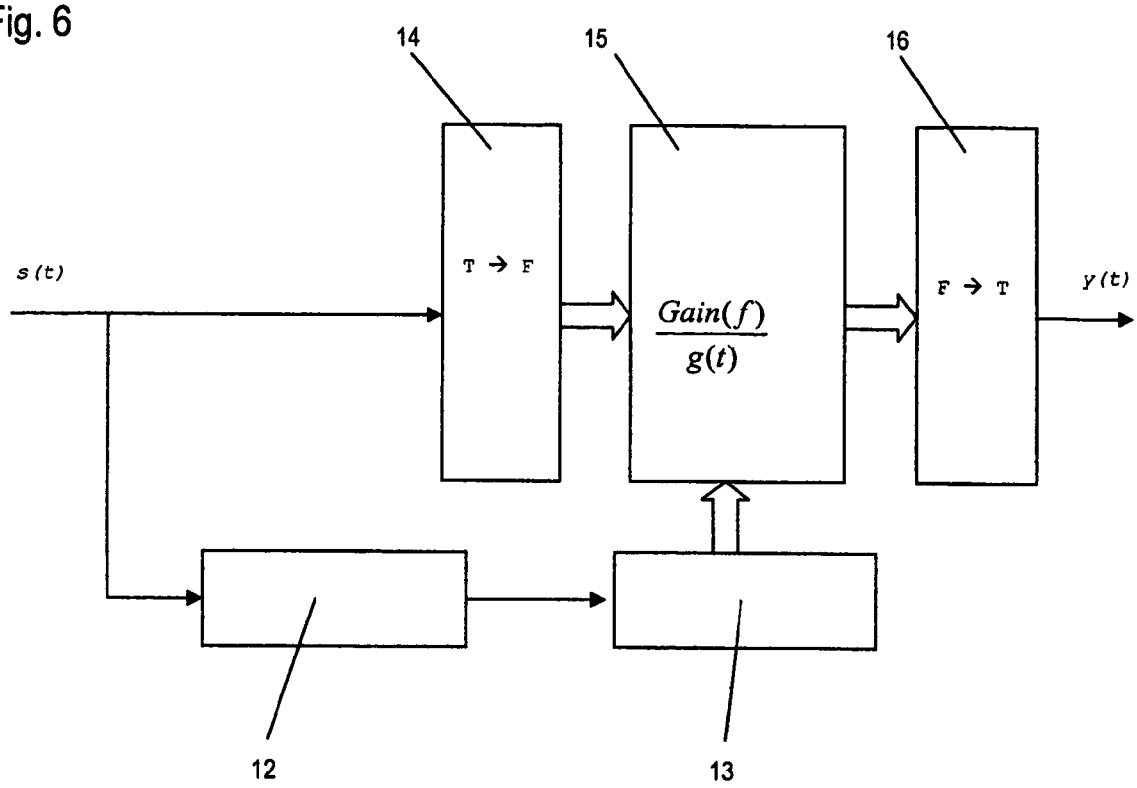
FIG. 6 schematically, a block diagram of the detection of a shock event in the time-domain and the treatment or management respectively in the frequency domain according an embodiment of the present invention.
Figure 7:
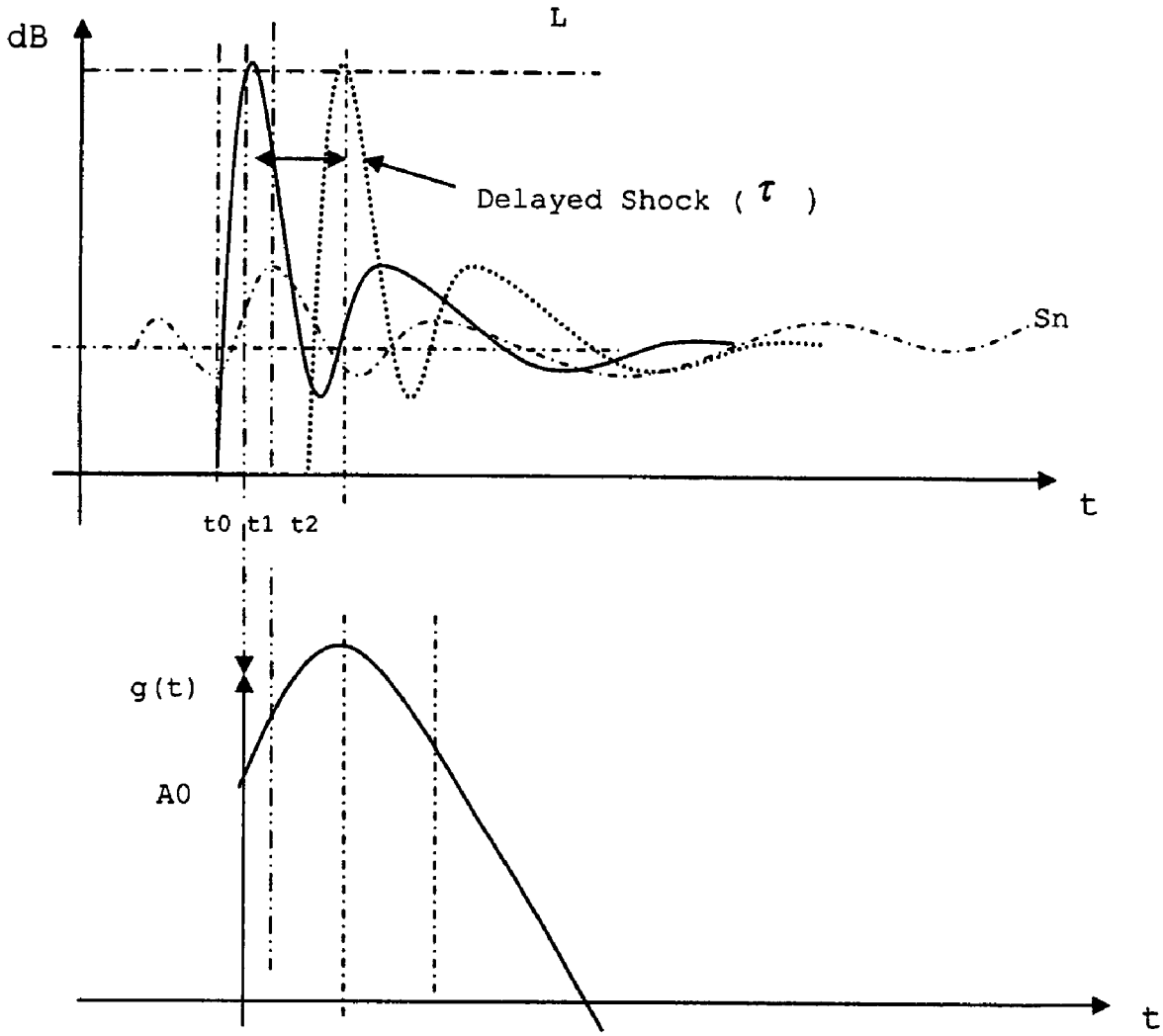
FIG. 7 a double plot of curves showing above the signal of a shock signal as a function of time, the delayed shock signal with the system group-delay (τ) and below the implemented gain reduction in the frequency-domain according to FIG. 6 with the consideration of system group-delay (τ) for zero-delay or predictable anti-shock management.

In a second embodiment of the present invention, the shock detection takes place in the time-domain whereas the treatment or management respectively of the signal takes place in the frequency-domain, as depicted schematically in FIG. 6.

The shock detection will be carried out by the shock detection module 12 in the time domain as already described above with no additional time delay required. The signal s(t) in the time-domain is then transformed into frequency domain by a FFT module 14 for any frequency-domain signal processing in module 15 and the anti-shock management by the anti-shock management module 13. Afterwards, the frequency-domain signal gain (f) is transformed back to time-domain by the FTT module 16 resulting in a new signal y(t).

For example, the signal transformation from time-domain to frequency-domain and then back to time-domain is frame-based by applying a certain window such as Hanning or Hamming. The frame size is typical $2^N$ samples such as 64 (N=5) for 32-bit FFT, which corresponds to a time length 3.2 ms for a sampling rate of 20 kHz. This creates a certain time-delay τ (such as 1 ms~10 ms; according to the actual system implementation) between the signal input and signal output. The fast shock detection in time-domain provides early prediction for anti-shock processing in frequency-domain. An adaptive anti-shock management plan can thus be specified to suppress shock without artificial break of anti-shock.

In the anti-shock management module 13, the anti-shock gain reduction g(t) may be divided into three anti-shock phases, such as anti-shock attack phase, anti-shock holding phase and anti-shock release phase.

Anti-Shock Attack Phase:

$$g(t)=A_0\exp^{\alpha(t-t1)} \text{ with } t\epsilon(t1,t1+\tau)$$

where $A_0$ is an initial gain reduction and $\alpha$ is the time constant for anti-shock attack speed;

Anti-Shock Holding Phase:

$$g(t)=(A_0\exp^{\alpha\tau})\cdot\exp^{-\beta(t-t1-\tau)} \text{ with } t\epsilon(t1+\tau,t2+\tau)$$

where $\beta$ can have the same meaning as described above; and

Anti-Shock Release Phase:

$$g(t)=(A_0\exp^{\alpha\tau-\beta(t2-t1)})\cdot\exp^{-\lambda(t-t2-\tau)} \text{ with } t>(t2+\tau)$$

where $\lambda$ can have the same meaning as described above.

The factors $A_0$, $\alpha$, $\beta$ or $\lambda$ can be pre-defined as constants or they can be adaptively updated according to the shock contrast level dL, shock index SI or Shock Duration T. In general, the higher the shock contrast level dL and/or the higher Shock Index SI, the higher $A_0$ and/or $\alpha$ will be. The shorter the system delay, the higher $\alpha$ will be.

Unlike the shock-detection which is applied in the time-domain and performs broadband, the above described anti-shock processing is applied in different frequency bands independently, as already shown in FIG. 2. Each frequency band can have a different weighting factor adjusted according to preferences. This can result in an effective anti-shock system for the preferable hearing compensation or comfort.

In addition to using the above anti-shock management functions, different activation functions can be selected according to the shock type and the user preference.

Figure 8:
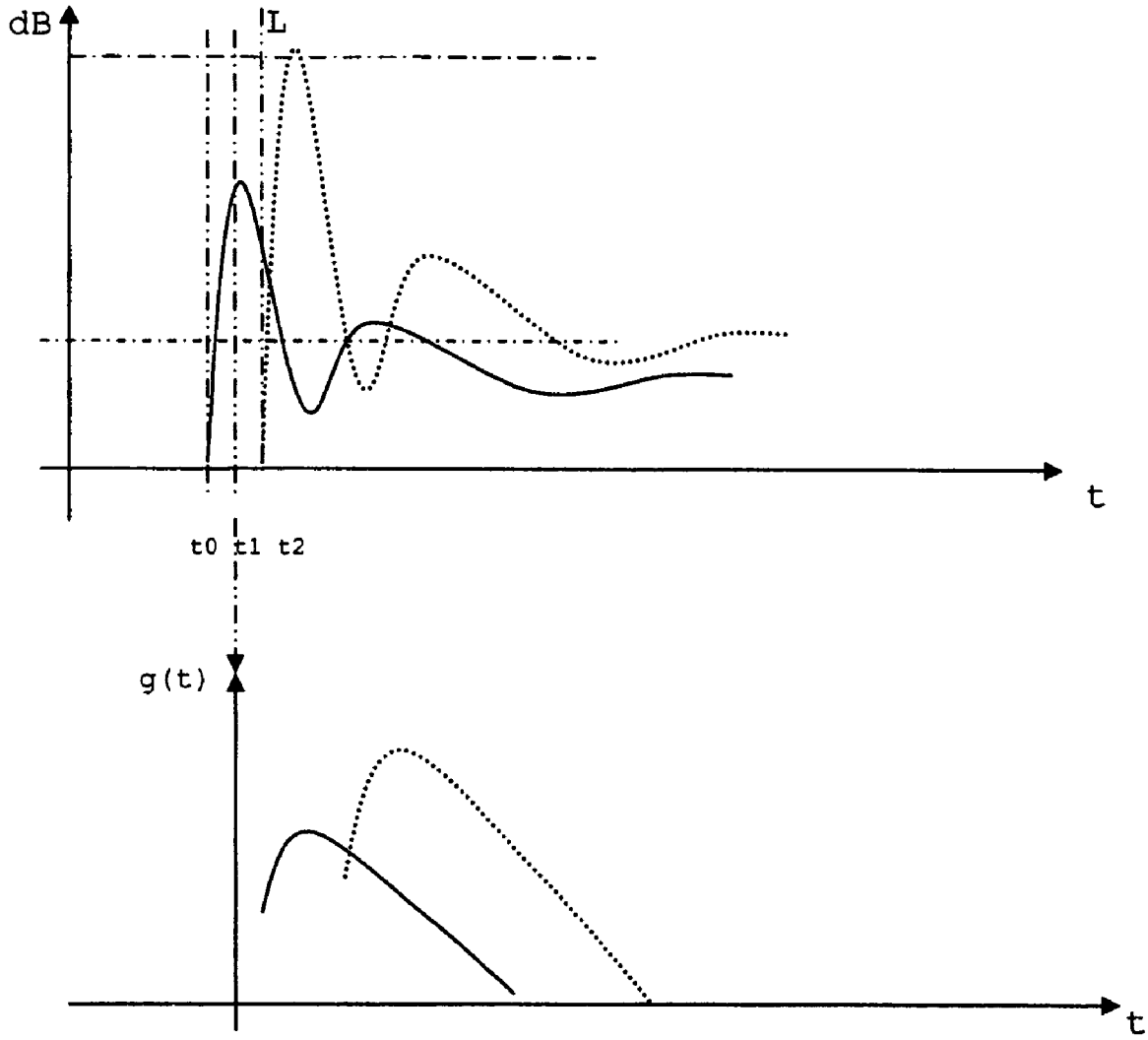
FIG. 8 a double plot of curves according to FIG. 7 with a second stronger shock following a first weaker shock.
Figure 9:
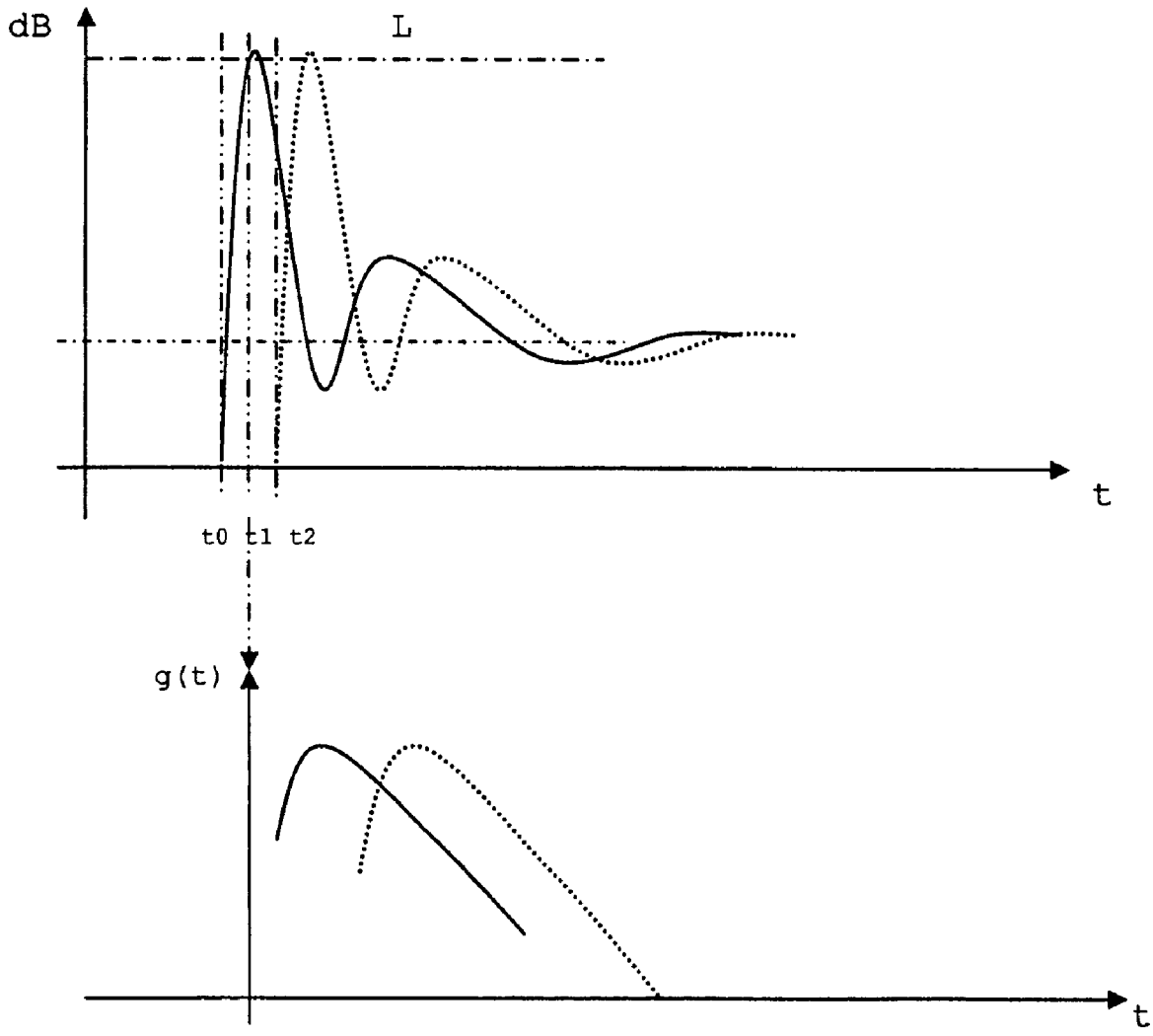
FIG. 9 a double plot of curves according to FIG. 7 with two equal shocks following each other in a short period of time.
Figure 10:
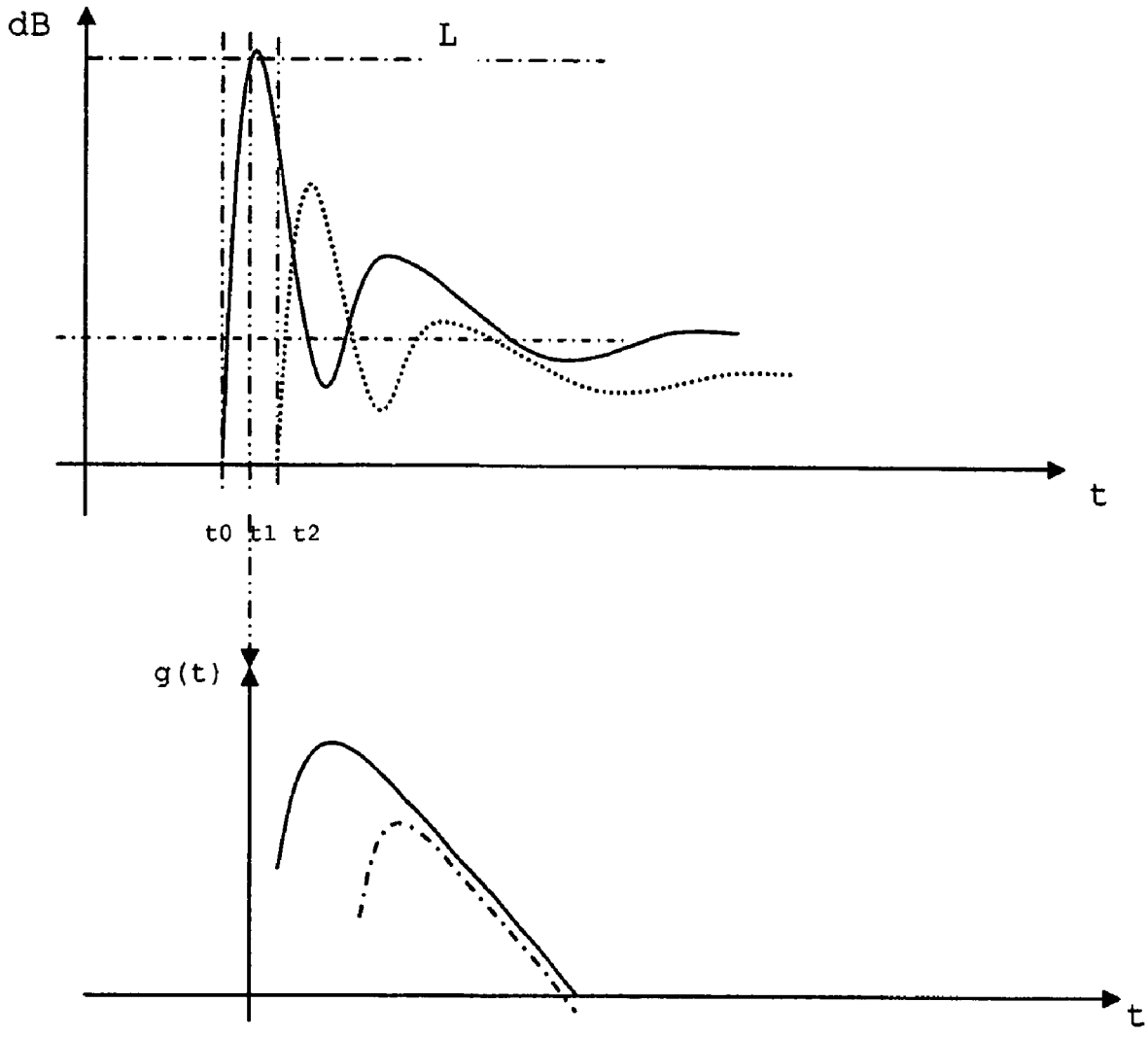
FIG. 10 a double plot of curves according to FIG. 7 with a second weaker shock following a first stronger shock.

The method according the present invention is not only suitable for single shock events, but will also handle multiple shock events. FIGS. 8 to 10 displays three different types of multiple shock events:

A second stronger shock follows a first weaker shock, as depicted in FIG. 8. In this case, the stronger shock will mask the previous one and the new anti-shock for the stronger shock will take over the control once the stronger shock is detected.

An equal shock follows a first shock, as depicted in FIG. 9. In this case, the actual anti-shock relation depends on time difference between the two shocks. If they are very close, they will be detected as only one shock. If the time difference is big enough, they will be detected as two separate shocks and a similar anti-shock processing will be applied to both independently.

A weaker second shock follows a stronger first shock, as depicted in FIG. 10. In this case, the weaker shock after the strong shock can be masked by the stronger shock, if the time difference between them is short. If the weaker shock happens a certain time after the stronger one, it can be detected as a new shock and new anti-shock processing is applied.

Therefore, a stronger shock happening right after a weaker shock will overtake the weaker shock management, while a stronger shock management will not be affected by a following weaker shock.

A zero-delay or predictive shock detection and adaptive shock management has thus been achieved. Shock detection takes place with zero time delay, or even predicts the shock before it fully goes through the signal processing.

The present method thus is highly efficient and very fast and may be used for shock detection and shock reduction.

While reducing acoustic shock adaptively, it keeps the natural sound quality of shock events for environmental awareness by the user maintained and does not hamper the user's safety. This method is capable of detecting and canceling acoustic shocks adaptively under different environments and reducing the shock in an optimized way to keep the natural sound quality of shock events. It can detect various acoustic shocks reliably and adaptively to the environment. The acoustic shock detection results in a shock index, which reflects the actual shock strength and allows more adaptive shock reduction accordingly. This is also very different from most other transient or impulse detection technologies which simply detect whether a transient or impulse is present or not. Based on the continuous shock detection resulting shock index SI, an adaptive shock management is carried out to adaptively reduce the acoustic shock.

Finally, it is expressly pointed out that the method and system according to the present invention can not only be used in connection with a correction of hearing impairment, but also can be very well used in connection with any wired or wireless communication device. In this sense, the term "hearing device" must be understood as hearing aid, be it introduced in the ear canal or implanted into a patient, to correct a hearing impairment as well as to any communication device used to facilitate or improve communication.

What is claimed is:

1. A method for detecting acoustic shock in an audio input signal (s(t)), comprising the steps of monitoring the input signal (s(t)) in the time-domain, thereby detecting a signal floor (Sn), detecting a peak level of the input signal (L), detecting an attack time (t1-t0) of the input signal as a time difference between a time (t1) when the peak level of the input signal (L) is detected and a time (t0) when the acoustic shock being detected begins, determining a shock contrast level (dL) as a difference between the peak level (L) and the signal floor (Sn), determining a shock index (SI) based on a shock index normalization constant ($\sigma$), the shock contrast level (dL) and the attack time (t1-t0), comparing the shock contrast level (dL) and the shock index (SI) with respective thresholds (MCL; MSI) and indicating an acoustic shock if one or both of said thresholds (MCL; MSI) are exceeded.

2. Method according to claim 1 characterized in that the signal floor (Sn) is obtained through a signal processing method catching up the non-transient signal change over time.

3. Method according to claim 2 characterized in that the signal processing method is provided by a lowpass filter or a fast smooth signal processing.

4. Method according to claim 1 characterized in that the signal floor (Sn) is derived from the following formula $$Sn = 10\log\left[\frac{1}{T_0}\int_{t-T_0}^{t}|s(t)dt\right]$$

5. Method according claim 4 characterized in that the averaging of s(t) will be performed for a short time period $T_0$ of about 4 ms or less.

6. A method according to claim 1 characterized in that the shock index (SI) is derived from the following formula:

$$SI = \sigma \frac{L - S_n}{t_1 - t_0}$$

wherein σ is the coefficient for shock index normalization.

7. A method according to claim 6, characterized in that the coefficient for shock index normalization (σ) is pre-defined for typical shock events or is determined by a self-learning process.

8. A method according to claim 1, characterized in that it further comprises the step of applying anti-shock gain reduction (g(t)) when a shock event has been indicated.

9. A method according to claim 8 characterized in that an anti-shock gain reduction (g(t)) is applied in time-domain to the input signal (s(t)) resulting in a new signal (x(t)) with completed anti-shock processing.

10. A method according to claim 9 characterized in that the anti-shock gain reduction (g(t)) is applied to the input signal (s(t)) after adding signal delay.

11. A method according to claim 8 characterized in that an anti-shock gain reduction (g(t)) is applied in the frequency-domain.

12. A method according to claim 8 characterized in that the anti-shock gain reduction (g(t)) is applied in different frequency bands independently.

13. A method according to claim 8 characterized in that additionally different activation functions are selected according to the shock type or a user preference.

14. Application of the method according to claim 1 for operating a hearing device.

15. An audio signal processing system for detecting acoustic shock in a audio input signal s(t) comprising at least one shock detection module (12) with means that permits the monitoring the input signal (s(t)) in a time-domain, thereby detecting a signal floor (Sn), detecting a peak level of the audio input signal (L), detecting an attack time (t1-t0) of the input signal as a time difference between a time (t1) when the peak level of the input signal (L) is detected and a time (t0) when the acoustic shock being detected begins, determining a shock contrast level (dL) as a difference between the peak level (L) and the signal floor (Sn), determining a shock index (SI) based on a shock index normalization constant (σ), the shock contrast level (dL) and the attack time (t1-t0), comparing the shock contrast level (dL) and the shock index (SI) with respective thresholds (MCL; MSI) and indicating an acoustic shock if one or both of said thresholds (MCL; MSI) are exceeded.

16. A system according to claim 15 characterized in that it further comprises at least one managing module (13) with means that permits applying anti-shock gain reduction (g(t)) when a shock event has been indicated.

17. A system according to claim 16 characterized in that the managing module (13) is working in the time-domain.

18. A system according to claim 16 characterized in that the managing module (13) is working in the frequency-domain.

19. A method for detecting acoustic shock in an audio input signal (s(t)), comprising the steps of monitoring the input signal (s(t)) in a time-domain, thereby detecting a signal floor (Sn), detecting a peak level of the audio input signal (L), detecting an attack time of the input signal (t1-t0), determining a shock contrast level (dL) as a difference between the peak level (L) and the signal floor (Sn), determining a shock index (SI) by use of a shock index normalization constant (σ), wherein the shock index (SI) is derived as follows:

$$SI = \sigma \frac{L - S_n}{t_1 - t_0}$$

wherein σ is the coefficient for shock index normalization comparing the shock contrast level (dL) and the shock index (SI) with respective thresholds (MCL; MSI) and indicating an acoustic shock if one or both of said thresholds (MCL; MSI) are exceeded.

20. A method according to claim 8, wherein the anti-shock gain reduction (g(t)) is dependent on at least one of a shock duration (T), the shock contrast level (dL) and the shock index (SI).

21. A system according to claim 16, wherein the anti-shock gain reduction (g(t)) to be applied by the means that permits applying anti-shock gain reduction is dependent on at least one of the shock duration (T), the shock contrast level (dL) and the shock index (SI).

* * * * *